US005340024A

United States Patent [19]

Fuller et al.

[11] Patent Number: 5,340,024

[45] Date of Patent: Aug. 23, 1994

[54] NUMERICALLY CONTROLLED WATER JET DISPLAY POOL

[76] Inventors: Mark Fuller, 10711 Bluffside Dr. #101, Studio City, Calif. 91604; Alan Robinson, 5349 C N. Peck Rd., El Monte, Calif. 91732

[21] Appl. No.: 144,840

[22] Filed: Oct. 27, 1993

[51] Int. Cl.[5] ..... B05B 17/08

[52] U.S. Cl. ..... 239/17; 239/211; 40/406

[58] Field of Search ..... 239/16–23, 239/211; 40/406, 407

[56] References Cited

U.S. PATENT DOCUMENTS

| | | | |
|---|---|---|---|
| 3,292,861 | 12/1966 | Kawamura et al. | 239/17 |
| 3,640,463 | 2/1972 | Kawamura et al. | 239/17 |
| 4,094,464 | 6/1978 | Kawamura et al. | 239/17 |
| 4,111,363 | 9/1978 | Kawamura et al. | 239/20 |
| 4,208,848 | 6/1980 | Kohl | 40/406 |
| 4,892,250 | 1/1990 | Fuller et al. | 239/18 |
| 5,106,660 | 4/1992 | Vorel | 40/406 |

FOREIGN PATENT DOCUMENTS

| | | | |
|---|---|---|---|
| 150276 | 11/1979 | Japan | 40/406 |

*Primary Examiner*—Karen B. Merritt

*Attorney, Agent, or Firm*—Blakely, Sokoloff, Taylor & Zafman

[57] ABSTRACT

A water device that can display predetermined patterns that form letters, numbers, pictures or other visually apparent figures. The water display has a shallow pool of water with a flat bottom surface, that has a plurality of holes spaced apart in a grid like fashion. The holes are connected to a source of air that introduces bubbles into the pool. The air exits the water in such a manner as to leave a visually distinguishable mark or impression in the pool. The bubbles are combined and patterned into an identifiable figure such as a word or a set of numbers. Each hole has a solenoid valve that allows air to flow into the pool when the solenoid is energized. The valves are connected to a computer that selects which holes are to release air and when the bubbles are to be released. The actuation of the valves can be selected and sequenced in accordance with the operating instructions of a computer program, that produce a pattern of bubbles to create the desired form on the surface of the pool.

17 Claims, 1 Drawing Sheet

NUMERICALLY CONTROLLED WATER JET DISPLAY POOL

BACKGROUND OF THE INVENTION

1. Field of the Invention

This invention relates to water displays, in particular a pool of water that can produce a visually apparent predetermined pattern.

2. Description of Related Art

Water displays have been typically installed on the grounds of public buildings, to improve the aesthetic features of the surrounding area. Usually the devices are falling fountains or directed streams of water located within a pool. Occasionally fountains will incorporate means to vary the height or trajectory of the water, thereby changing the appearance of the display. Such systems are typically limited to two or three different displays, or may have a continuously varying stream that is repeated over time. Changing the display usually requires shutting down the fountain and manually adjusting the nozzles that direct the water.

Digital displays such as the message boards found on the outside of banks, are a common way of providing information to viewers. Such boards are usually constructed with a plurality of individual light bulbs, wherein the bulbs are illuminated in a pattern to form the desired number or letter. In addition to relaying the time and temperature, such displays can also provide other information including advertising and the news. Such message boards are popular among institutions because of their size and their ability to attract the attention of the viewers. Therefore it would be desirable to provide a water display that can create visually apparent predetermined patterns that can relay time and other information, without turning off the display or manually adjusting the device.

SUMMARY OF THE INVENTION

The present invention is a water device that can display predetermined patterns that form letters, numbers, pictures or other visually apparent figures. The water display has a shallow pool of water with a flat bottom surface. The bottom of the pool has a plurality of holes spaced apart in a grid like fashion. The holes are connected to a source of air that introduces bubbles into the pool. The air exits the water in such a manner as to leave a visually distinguishable mark or impression in the pool. The bubbles are combined and patterned into an identifiable figure such as a word or a set of numbers. Each hole has a solenoid valve that allows air to flow into the pool when the solenoid is energized. The valves are connected to a computer that selects which holes are to release air and when the bubbles are to be released. The actuation of the valves can be selected and sequenced in accordance with the operating instructions of a computer program, that produce a pattern of bubbles to create the desired form on the surface of the pool. The bottom of the pool is preferably opaque so that the bubbles contrast with the pool, to allow the viewer to more easily distinguish the pattern that is being displayed. The holes preferably each have a spring loaded check valve that releases a high pressure bubble so that the display may be more accurately controlled. The patterns presented can be the time, a company logo or other information.

Therefore it is an object of this invention to provide a water display that can provide an infinite amount of predetermined patterns.

It is also an object of this invention to provide a water device that can display visually apparent forms such as time, letters or other information.

It is also an object of this invention to provide a water device that automatically changes the display shown by the device.

BRIEF DESCRIPTION OF THE DRAWINGS

The objects and advantages of the present invention will become more readily apparent to those skilled in the art after reviewing the following detailed description and accompanying drawings, wherein.

DETAILED DESCRIPTION OF THE INVENTION

Figure 1:
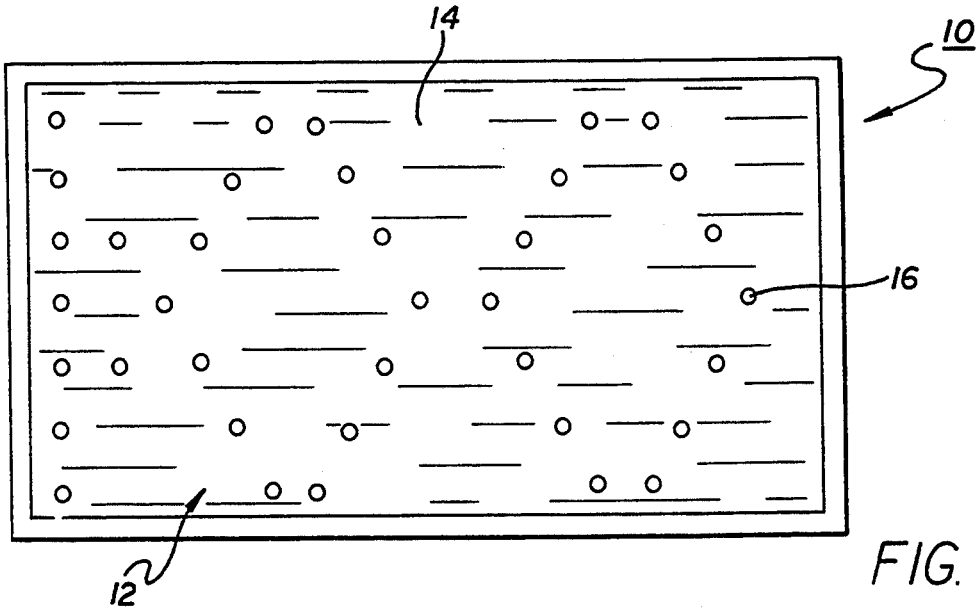
FIG. 1 is a top view of the water display of the present invention, showing a predetermined pattern in a pool of water indicating the time of day.

Referring to the drawings more particularly by reference numbers, FIG. 1 shows a water display 10 of the present invention. The display 10 has a pool 12 that contains a thin layer of water 14. Air bubbles 16 are introduced into the water 14 in a predetermined pattern, to display an image on the top of the pool 12. The image displayed can be numbers, letters, figures or other visually apparent forms. As shown in FIG. 1, the pattern can be constructed to display the time of day. The pool would typically be located in a position so that it can be seen by viewers. For instance, the display can be located below a bridge such that passersby can look down into the pool to see the form being shown. Along these lines, the pool can be located at the entrance of a private commercial building, wherein the image displayed is the company logo or a message to welcome any visitors. The pool can also be located at the base of a tall commercial building such that the occupants of the building can view the display from above. It is also possible to construct the pool at an angle oblique to the ground, such that the display can be seen from ground level. With such an embodiment, water would have to continuously flow from the top to the bottom of the pool.

Figure 2:
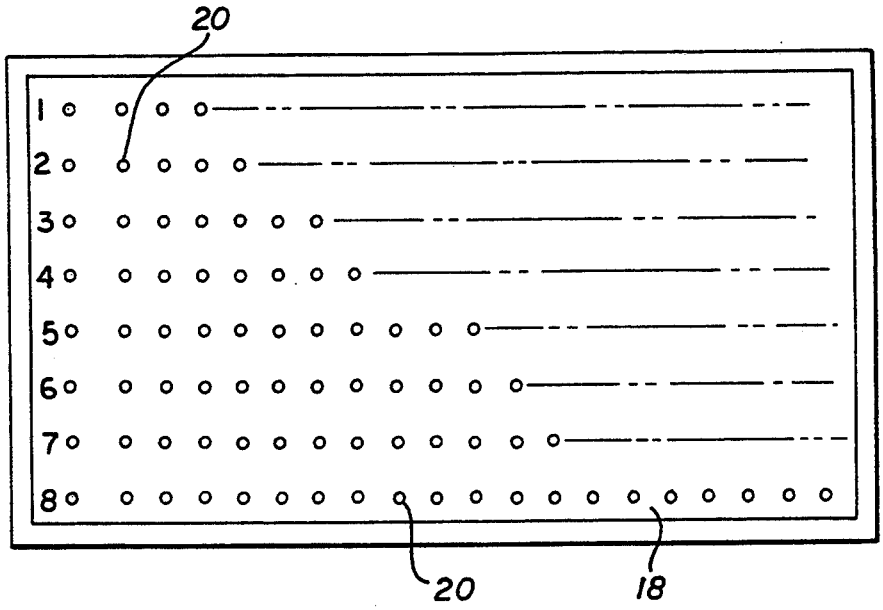
FIG. 2 is a top view of the water display, showing a plurality of holes in the floor of the pool.

As shown in FIG. 2, the pool 12 has a floor 18 with a plurality of holes 20 spaced along the bottom of the pool 12. The holes 20 allow air 16 to be introduced into the water 14. The holes 20 are preferably spaced apart in a grid like pattern to form a matrix, such that a selected number of holes can release air into the pool to form a predetermined pattern as discussed above. In the preferred embodiment the floor 18 is opaque so that the bubbles 16 are more apparent to the viewers. The holes 20 are typically small enough such that the pool 12 appears as a black slab of stone. The water is preferably between one-eight and two inches deep, so that the air does not have a long distance to travel when released from the holes 20. With a shallow pool, the air travels to the surface of the pool almost instantaneously, insuring that the release of air is synchronous throughout the pool. The short distance between the hole and the surface of the water also reduces the amount of wave disturbance within the pool.

Figure 3:
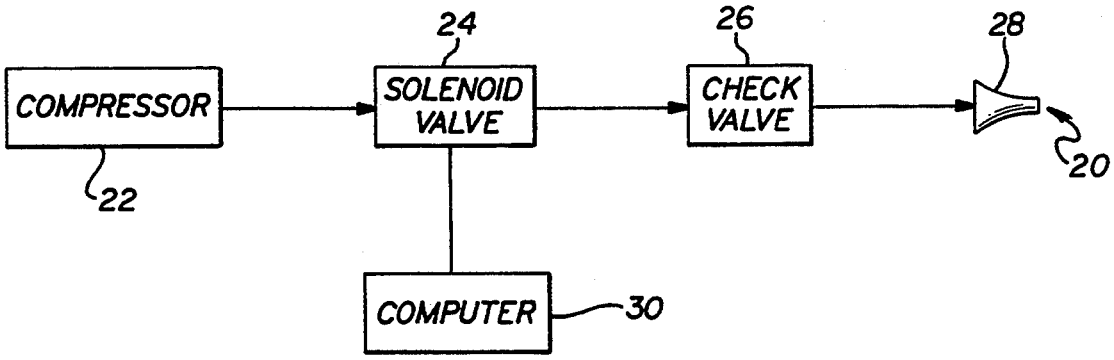
FIG. 3 is a schematic diagram of the air system of the water display, showing a computer connected to a solenoid valve that controls the flow of air from an air source to a hole.

As shown in FIG. 3, the holes 20 are connected to a source of pressurized air 22, typically an air compressor which is commercially available and well know in the art. Between the compressor 22 and each hole 20, is a valve 24 that controls the flow of the air into each hole 20. A solenoid activated two-way valve is preferred, wherein the valve allows air to flow to the hole 20 when the solenoid is energized and in an open position, and the valve prevents airflow when the solenoid is not energized and is in a closed position. Such valves are again commercially available and well known in the art. Between the solenoid valve 24 and the hole 20 is a check valve 26 that prevents water from flowing down into the compressor 22. The check valve 26 can be spring loaded such that when the solenoid valve is open, the check valve prevents airflow to the hole until the air pressure reaches a predetermined level. The check valve 26 creates a series of high pressure air bubbles that are easier to control. With such an arrangement the air quickly exists the water without producing any residual waves or trailing air bubbles that would have to disperse before the next operating sequence began. For example, if one of the holes was emitting high pressure air bubbles that form part of a pattern and the pattern is changed such that the hole is no longer required to exhaust air, the quick dispersement of the bubble allows that segment of the water to have a transparent undisturbed appearance almost instantaneously. If the check valve was not incorporated, air would flow through the water from the hole in a continuous stream. When the solenoid valve is deenergized the trailing edge of the airstream would continue to float up through the water, producing a residual bubble pattern on the surface of the water. To change the pattern on the surface of the pool, a pause would have to be introduced to allow the last portion of the airstream to emerge from the water. The residual airstream and the nonsynchronization of the changing patterns would be visual apparent and would detract from the overall effect of the display. With the check valve installed, the patterns can be rapidly changed such that the pool simulates an electronic display board. The holes 20 may have nozzles 28 incorporated to increase the velocity of the air and to accurately direct the bubbles 16 to a predetermined location within the pool 12. By controlling the location of the air strew, the nozzles 28 can provide a more precise pattern of air bubbles 16 to improve the overall definition of the pattern.

The solenoid valves 24 can be connected to a computer 30, which provides output signals to energize the solenoids and open up the valves 24 in accordance with the operating instructions of a computer program. The computer program selects which valves are to be opened so that a predetermined pattern is formed in the pool. The computer may be a controller with a plurality of hardwired terminals that each connect with the solenoid of each valve 24. Each terminal is either opened or closed in accordance with the program within the controller. When a terminal is closed the corresponding solenoid valve 24 is energized and opened, allowing air to flow into the pool of water. For example the holes in FIG. 2 designated 1–8, would each have a terminal on the controller 1–8. When a straight line in the pool is desired, all of the terminals of the controller would be closed to provide air bubbles to the portion of the water immediately above the holes 1–8. If the holes 1–8 were to form part of the roman numeral 5, the terminals 1–3 and 8 would be closed to provide air in the holes designated 1–3 and 8, and so forth and so on. Such controllers are commercially available and known, particularly in the automated manufacturing art. The controller could be integrated with a personal computer such that new programs could be easily installed. The computer can be integrated with a telecommunication line, which has access to a news service to provide news updates that can be displayed in the pool. In another embodiment the controller/computer could have an internal timer such that the pool continuously displays the time of day. The computer 30 may have a conversion program that converts inputted characters such as letters and numbers into the proper output signals, such that the inputted characters are displayed in the pool. For instance if the letters A and B were inputted into the computer 30, the conversion program would open the necessary valves to create the letters A and B in the pool. In the alternative, the opening of the desired valves could be key punched directly into the computer 30. As shown and described, the present water device provides a display which can show an infinite amount of images, that can be easily and instantaneously changed into a different image.

While certain exemplary embodiments have been described in detail and shown in the accompanying drawings, it is to be understood that such embodiments are merely illustrative of, and not restrictive on the broad invention, and that this invention not be limited to the specific constructions and arrangements shown and described, since various other modifications may occur and to those ordinarily skilled in the art.

What is claimed is:

1. A water display that creates visual images, comprising:

a pool of water having a bottom beneath said water;

a plurality of apertures spaced apart a predetermined distance throughout said pool bottom;

air means for providing air to said apertures;

a plurality of air valves each operably connected to said air means and to a corresponding aperture, said air valves being constructed to introduce air into said pool of water through said corresponding apertures when said air valves are in an open position;

control means for providing input signals to said air valves to open a predetermined number of said air valves such that said opened air valves introduce air into said pool of water, wherein said air creates a predetermined pattern in said pool of water.

2. The water display as recited in claim 1, wherein said control means has a computer with a computer program that provides said input signals and opens a predetermined number of air valves in accordance with the operating instructions of said computer program.

3. The water display as recited in claim 2, wherein said computer is programmable such that a new set of operating instructions can be inserted into the computer.

4. The water display as recited in claim 1, wherein each said air valve is a solenoid air valve operably connected to said air means and said control means, such that when said solenoid air valve receives an input signal from said control means said solenoid air valve is energized and opened, allowing said air to flow from said air means to said corresponding aperture.

5. The water display as recited in claim 1, further comprising a plurality of check valves each operably connected to a corresponding air valve and aperture, such that when said air valves are opened said check valves allow said air to flow through said corresponding apertures when the pressure of said air reaches a predetermined level.

6. The water display as recited in claim 1, wherein each said aperture has a nozzle.

7. The water display as recited in claim 1, wherein said apertures are positioned along said pool bottom in a predetermined grid to create a matrix of apertures.

8. The water display as recited in claim 1, wherein said pool bottom is opaque.

9. The water display as recited in claim 1, wherein said predetermined pattern is one or more numerical features indicating the time of day.

10. The water display as recited in claim 1, wherein said water in said pool is less than two inches deep.

11. A water display that creates visual images, comprising:

a pool of water having a bottom beneath said water;

a plurality of apertures spaced apart a predetermined distance throughout said pool bottom;

air means for providing air to said apertures;

a plurality of solenoid air valves each operably connected to said air means and to a corresponding aperture, said solenoid air valves being constructed to introduce air into said pool of water through said corresponding apertures when said solenoid air valves are energized and in an open position;

a plurality of check valves each operably connected to a corresponding solenoid air valve and aperture, such that when said solenoid air valves are opened said check valves allow said air to flow through said corresponding apertures when the pressure of said air reaches a predetermined level; and, a computer that provides input signals to said solenoid air valves to energize and open a predetermined number of said solenoid air valves in accordance with the operating instructions of a computer program within said computer, wherein said opened solenoid air valves and said check valves introduce air into said pool of water such that said air creates a predetermined pattern in said pool of water.

12. The water display as recited in claim 11, wherein said computer is programmable such that a new set of operating instructions can be inserted into said computer.

13. The water display as recited in claim 11, wherein each said aperture has a nozzle.

14. The water display as recited in claim 13, wherein said apertures are positioned along said pool bottom in a predetermined grid to create a matrix of apertures.

15. The water display as recited in claim 14, wherein said pool bottom is opaque.

16. The system as recited in claim 15, wherein said water in said pool is less than two inches deep.

17. The system as recited in claim 16, wherein said predetermined pattern is one or more numerical features indicating the time of day.

* * * * *